US006552252B2

(12) United States Patent
Hirayama

(10) Patent No.: US 6,552,252 B2
(45) Date of Patent: Apr. 22, 2003

(54) TREMOLO FOR STRINGED MUSICAL INSTRUMENTS

(75) Inventor: Shinjiro Hirayama, Aichi (JP)

(73) Assignee: Hoshino Gakki Kabushiki Kaisha (JP)

( * ) Notice: Subject to any disclaimer, the term of this patent is extended or adjusted under 35 U.S.C. 154(b) by 0 days.

(21) Appl. No.: 10/125,368

(22) Filed: Apr. 16, 2002

(65) Prior Publication Data

US 2002/0194977 A1 Dec. 26, 2002

(30) Foreign Application Priority Data

Jun. 26, 2001 (JP) ..... 2001-192870

(51) Int. Cl.[7] ..... G10D 3/00
(52) U.S. Cl. ..... 84/313
(58) Field of Search ..... 84/290, 313, 299, 84/312 R, 267, 312 P, 298, 318, 319, 291

(56) References Cited

U.S. PATENT DOCUMENTS

| | | | | |
|---|---|---|---|---|
| 4,555,970 A | | 12/1985 | Rose | 84/313 |
| 4,763,555 A | | 8/1988 | Minakuchi et al. | 84/313 |
| 4,823,669 A | | 4/1989 | Sarricola, Jr. | 84/313 |
| 4,864,909 A | | 9/1989 | Toney | 84/313 |
| 4,869,145 A | | 9/1989 | Evans | 84/313 |
| 4,903,568 A | | 2/1990 | Itoh | 84/313 |
| 4,928,564 A | | 5/1990 | Borisoff et al. | 84/313 |
| 4,939,971 A | | 7/1990 | Satoh | 84/313 |
| 5,127,298 A | | 7/1992 | Snape et al. | 84/313 |
| 5,672,835 A | | 9/1997 | Doughty | 84/313 |
| 5,880,383 A | * | 3/1999 | Huff | 84/313 |
| 5,959,224 A | * | 9/1999 | McCune | 84/313 |
| 6,084,166 A | * | 7/2000 | Lee | 84/267 |

FOREIGN PATENT DOCUMENTS

| | | | |
|---|---|---|---|
| JP | 248120 | 12/1986 | 3/12 |
| JP | 193793 | 10/1987 | 3/12 |

* cited by examiner

*Primary Examiner*—Kim Lockett
(74) *Attorney, Agent, or Firm*—Ostrolenk, Faber, Gerb & Soffen, LLP

(57) ABSTRACT

A swingable tremolo for a string instrument. A tremolo block connected with the tremolo body is in turn connected through a link with a sliding block on the bottom of the instrument. A first spring urges the sliding block against the tensile force of the strings. A movable stopper is engageable by the sliding block as it moves rearward. A second spring also urges the movable stopper forward. The tensile force of the instrument strings is greater than the opposite force of first spring but less than the sum of the spring forces of the first and second springs, whereby the tremolo body may be tilted up or forwardly to reduce string tension or tilted down or rearwardly to increase string tension, and upon release of the tremolo body, the forces of the springs acting on the sliding block and the movable stopper act against the tensile force of the strings to bring the tremolo body into an equilibrium state.

14 Claims, 14 Drawing Sheets

TREMOLO FOR STRINGED MUSICAL INSTRUMENTS

BACKGROUND OF THE INVENTION

This invention relates to the tremolo device for stringed musical instruments.

TECHNOLOGY ACCORDING TO PRIOR ART

Tremolo devices for stringed instruments are widely used, particularly for electric guitars. The tremolo is operable for providing impressive acoustic effects by simultaneously increasing or decreasing the tension of all strings of a stringed instrument.

FIG. 14 shows a conventional tremolo device 120, installed on a body B of a stringed instrument, here a guitar. The tremolo is comprised of a tremolo body which serves as a guitar (bridge) 130 on which there is a string support 131 including a bridge saddle, etc. for the support of the guitar strings S. The string support 131 is arranged at the top surface of the body, while a tremolo block 132 protrudes below the top surface. A spring 140 maintains a state of equilibrium of the tremolo body 130 by working together with an arm 135 for manipulating the swinging of the tremolo body 130 installed on the surface of the instrument and the guitar string S that is spaced above the surface of the body B as the spring extends between the tremolo block 132 and the body B.

The tremolo body 130 remains at a location and orientation at which there is a balance between the tensile forces exerted by all of the strings S and the force of the spring 140 that works in the opposite direction for maintaining a state of equilibrium. As the tremolo body 130 is swung by moving the arm 135, the tension of all the strings S is simultaneously either increased or decreased, causing the musical intervals of the various strings S to either rise or drop. The tremolo body 130 returns to its original equilibrium position when the arm 135 is released. The musical intervals of the strings S are restored to the original intervals as the state of equilibrium is restored.

However, a balancing system for a tremolo body 130, which is based on the force of the spring 140 and on the tensile strength of the strings S, is extremely sensitive. Its tuning becomes out of order if the tremolo body 130 is not completely restored to its original state of equilibrium (which position in a balanced state serves as the central point) after the swinging of the tremolo body 130 due to such factors as friction at the swaying fulcrum of the tremolo body 130, the incompleteness of the restoring force of the spring 140, a performer's hand touching the tremolo body 130 or the arm 135 during a performance, choking (bending of the string) or fluttering (blurring of sound due to the moment of inertia that is produced at the time when the hand is suddenly taken away from the arm 135), or the mutilation of a string S.

Another major shortcoming of this tremolo device 120 is that tuning it is extremely difficult, because when tuning is performed until a certain string is raised to its target interval, the sum of the tensions of all of the strings S also increases. This moves the position of the state of equilibrium of the tremolo body 130 in the direction toward the neck of the guitar to the front, shortening the distance from the nut of the guitar to the string support part of the tremolo body, thereby reducing the tension of the other strings S, in turn causing the intervals of the other strings to decrease. Conversely, when the tension of some string S is lowered, the musical intervals of other strings S increases. Accordingly, it is theoretically impossible to completely and perfectly tune all of the strings S, and it requires an extremely large effort to bring the strings near to a perfectly tuned state.

For each string S there is a prescribed relationship among the target intervals, string density and the length of the string. Where one terminal end of the string S moves like the tremolo device 120 having a conventional structure, there are numerous neutral points that strike the balance in the tuning of the open strings, except for the scale length of the conventional stringed instruments, depending upon the strength of the spring 140. Accordingly, the desired musical intervals cannot be obtained if a state of equilibrium is achieved in front or at the back of the design location of the state of equilibrium (neutral point), even when the fretting on the guitar neck may be controlled.

There has been great interest in overcoming the above described shortcomings of the tremolo device 120. Recently, many tremolo devices employing a string which is stronger than the tensile force of known strings have been proposed, as described in Toku Kai Hei 1-93793 and Toku Ko Hei 2-48120, etc.

The mechanism described in Toku Kai Hei 1-93793, however, requires applying an extremely strong force for operating the tremolo arm when the musical intervals are to be raised through an increase in the tensile force of the string.

In the tremolo device in Toku Kai Hei 2-48120, on the other hand, the restoring force of the spring may be affected because the spring is tilted or deformed in a direction other than its direction of expansion or contraction when the tremolo body is swung, as the tremolo block and the spring are directly connected to each other. Moreover, in this tremolo device, the sound created at contact between a stopper and the tremolo body for stopping the tremolo body is quite large. When a buffer member, e.g. of rubber, etc. is interposed between the two elements to control the sound, the small size of the contact area contributes toward increasing the amount of the deformation of the buffer member and produces erroneous tuning.

In addition, this tremolo device has many places requiring adjustment. It is difficult for the user to determine locations requiring adjustment and the appropriate method for such adjustment.

SUMMARY OF THE INVENTION

This invention was directed toward the above described circumstances. Its purpose is to provide a tremolo device for the stringed instruments, which is capable of minimizing erroneous tuning, making it possible to easily and accurately carry out tuning, and to reduce the contact sound produced when the tremolo body is swung, and where the number of the locations requiring adjustment is small.

The invention relates to a tremolo for a stringed instrument, constructed to obtain musical intervals by changing the tension of a string of the instrument through the swinging of the tremolo body based on the operation of an arm. A tremolo body is installed on the body of the stringed instrument to swing freely, with a string support for the support of the string being arranged on the top surface and a tremolo block protruding toward the bottom side. An arm installed on the tremolo body is operated to manipulate the swinging of the tremolo body. A reverse side mechanism base is arranged below said body. A positioning stopper is provided at the bottom of the base or body. A slide block is constructed to be able to move freely to the front or to the rear. A movable stopper is movable back and forth freely and is capable of contacting or mi moving away from the slide block. A link links the tremolo block and the slide block.

A first spring between the bottom side mechanism base and the slide block urges the slide block toward the front. A second spring between the movable stopper and the bottom side mechanism base also urges the movable stopper to the front. When the tremolo arm is not being operated, the slide block and the movable stopper contact and the movable stopper and the positioning stopper contact due to the tensile strength of the string disposed above the body. The forces of the first and second springs bring the tremolo body into a state of equilibrium.

When the tremolo body is swung to tilt toward the front by operating the arm, the tremolo block is rotated to the rear. As a result, the slide block and the movable stopper slide rearward joined by the link. When the movable stopper has been separated from the positioning stopper, and while the operation of the tremolo arm has been discontinued, the slide block and the movable stopper are restored to their original positions where the movable stopper contacts the positioning stopper due to the urging strength of the first spring and the second spring. This brings the tremolo body into a state of equilibrium.

When the tremolo body is swung to tilt rearward by the operation of the tremolo arm, the tremolo block rotates to the front, which slides the slide block to the front through the link. That separates the slide block from the movable stopper. When operation of the tremolo arm has been discontinued, the slide block is returned to its original position touching the movable stopper by the tensile force of the string, thereby restoring the tremolo body to the state of equilibrium.

An axial slide is provided between a first bearing and a second bearing on the bottom side mechanism base. The slide block and the movable stopper are movable freely back and forth along the axial slide. The positioning stopper is provided between the first bearing and the second bearing at the rear or bottom of the base.

The movable stopper has a front which can either touch or move away from the slide block and has a rear which can touch or move away from the positioning stopper.

The second spring is provided between the front of the movable stopper and the second bearing.

The first spring is provided between the first spring front side installation block that has been provided on the front end of the bottom side mechanism base and the first spring rear-side installation block provided on the slide block.

The rotation fulcrum for the tremolo block and the link are positioned approximately right under the swing axis of the tremolo body.

The first spring front side installation block is installed such that its position may be adjusted with respect to the bottom side mechanism base.

A buffer is interposed between the slide block and the movable stopper. A buffer is also interposed between the movable stopper and the positioning stopper.

The link between the tremolo block and the slide block is capable of expansion and contraction.

The action direction of the forces of both the first spring and the second spring is opposite to the direction of the tensile force of the strings. The spring force of the first spring is smaller than the total tensile force of the string, while the sum of the spring forces of the first spring and the second spring is greater than the total tensile force of the string, for achieving equilibrium no matter whether the tremolo body is raised or lowered.

An engagement mechanism, which is capable of being engaged or disengaged, is provided between the slide block and movable stopper. The slide block and the movable stopper are engaged by the engagement mechanism, thereby regulating the movement of the slide block to the front.

Other features and advantages of the present invention will become apparent from the following description of the invention which refers to the accompanying drawings.

BRIEF DESCRIPTION OF THE DRAWINGS

FIG. 11 shows the essential part of the tremolo device of another embodiment wherein

DESCRIPTION OF PREFERRED EMBODIMENTS

Figure 1:
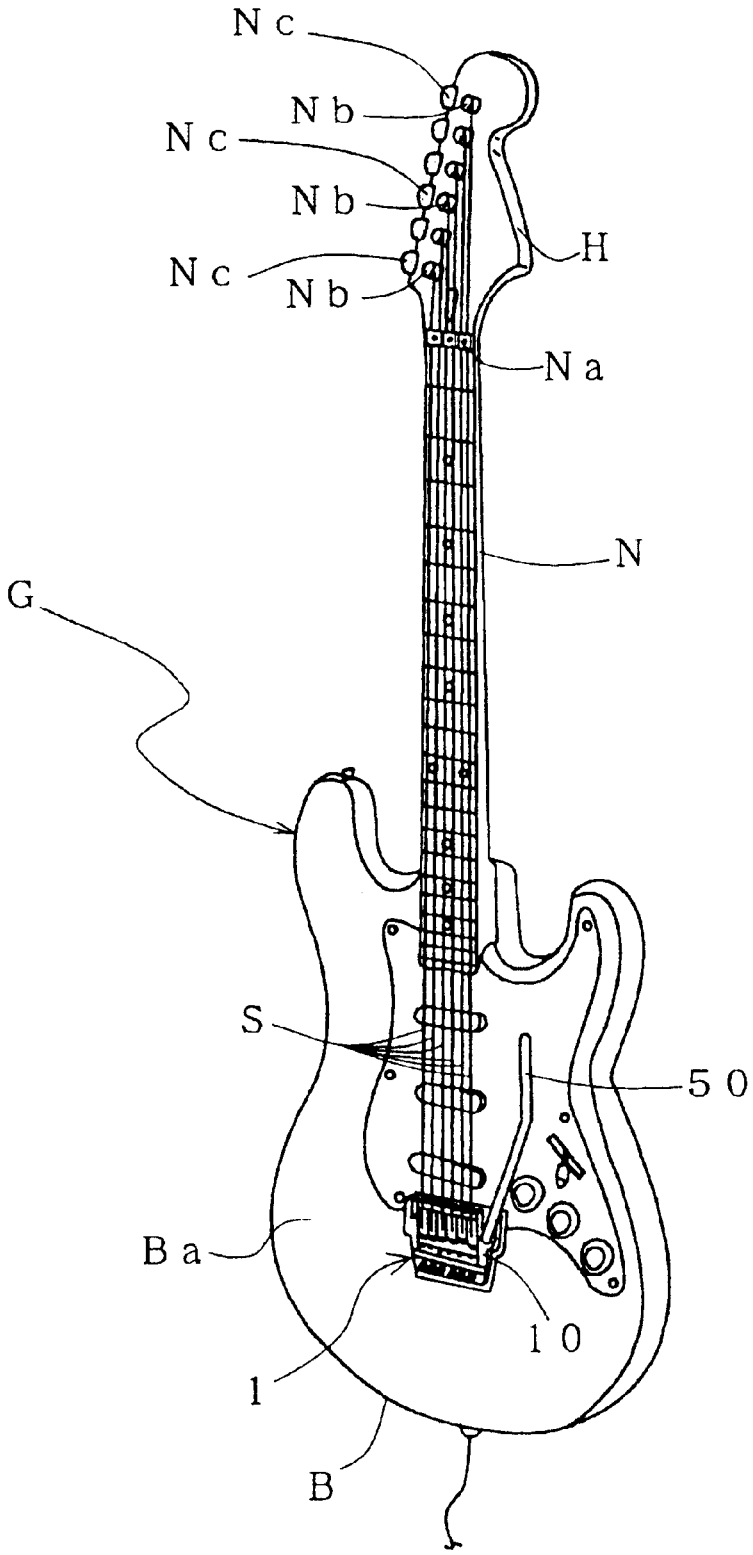
FIG. 1 is an oblique view of an electric guitar which incorporates a tremolo device for a stringed instrument according to one embodiment of the invention.

The example of a stringed instrument shown in FIG. 1 is an electric guitar G carrying an embodiment of the invention. The guitar includes a neck N and a body B. A head H is provided at the front end of the neck N. One terminal end region of each string S is securely held at the head H guitar by a respective string key Nb. A tremolo 1 which provides a guitar bridge is installed on the body B as a tuning device and an interval changing device. The end of each string S opposite the head H is held and fixed by the tremolo 1. A nut Na supports the head side terminal region of each string as the nut is positioned at the front edge of the neck N. A bobbin Nc for tuning as is linked to each string key Nb.

Referring to FIGS. 2 through 6, the tremolo 1 is comprised of an arm 50 for swinging the tremolo body 10. The arm 50 is installed on the tremolo body 10 to be movable freely along with tremolo body 10. A bottom side or reverse side restoring mechanism 60 restores the tremolo body 10 to an equilibrium state position, which is a neutral position in a balanced state subsequent to the swinging of the tremolo body 10. In this example, the reverse side mechanism 60 is arranged inside a concave Bb that is formed in the reverse or bottom side of the body B.

The tremolo body 10 in this example comprises a base plate 11 that is installed to swing freely with respect to the surface Ba of the body B. A string support, here a bridge saddle 20, supports the string S. A tremolo block 40 protrudes below the reverse side or bottom of the base plate 11.

Figure 3:
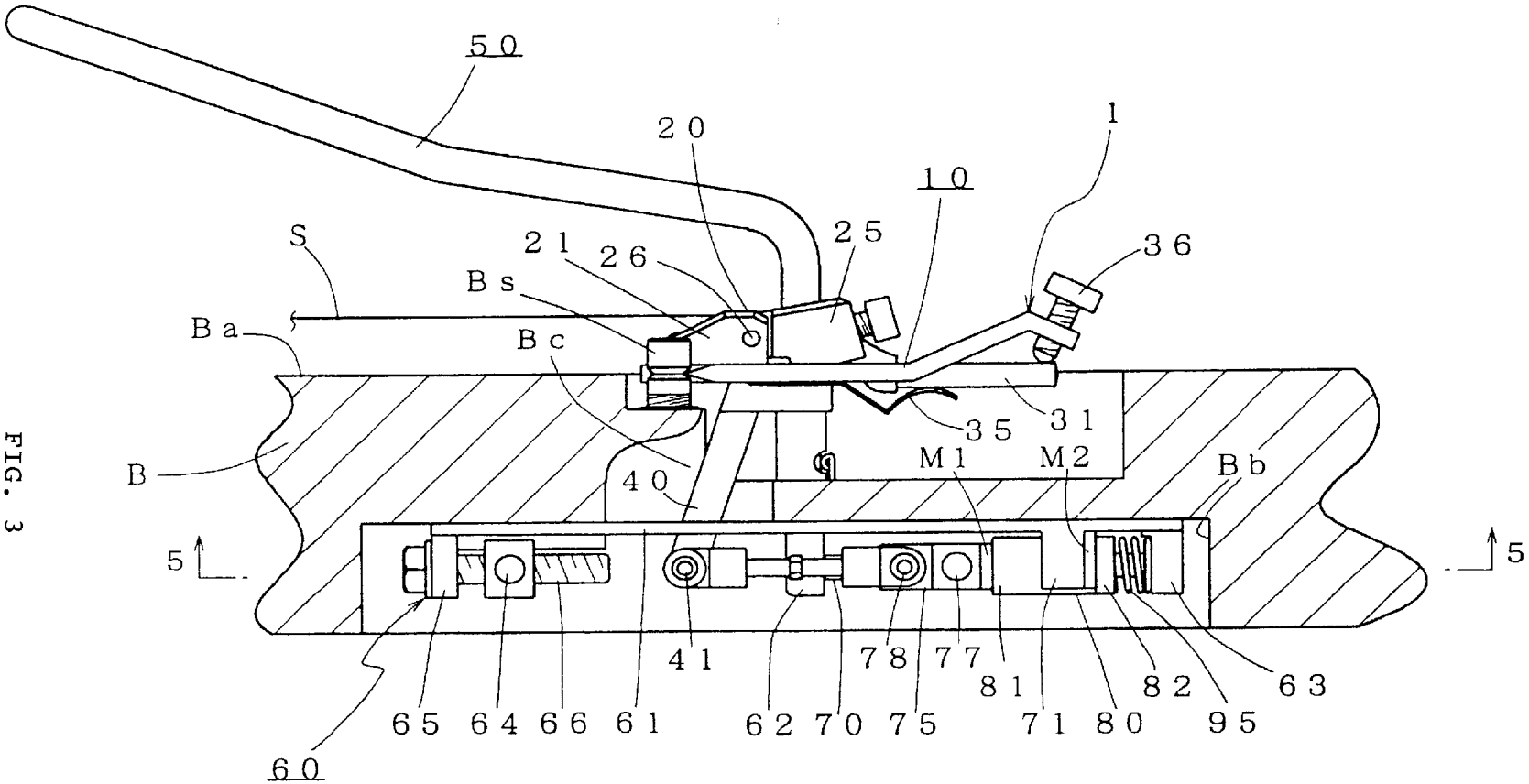
FIG. 3 is a side cross sectional view of the tremolo device, with some of its members having been removed, and showing surrounding elements.
Figure 4:
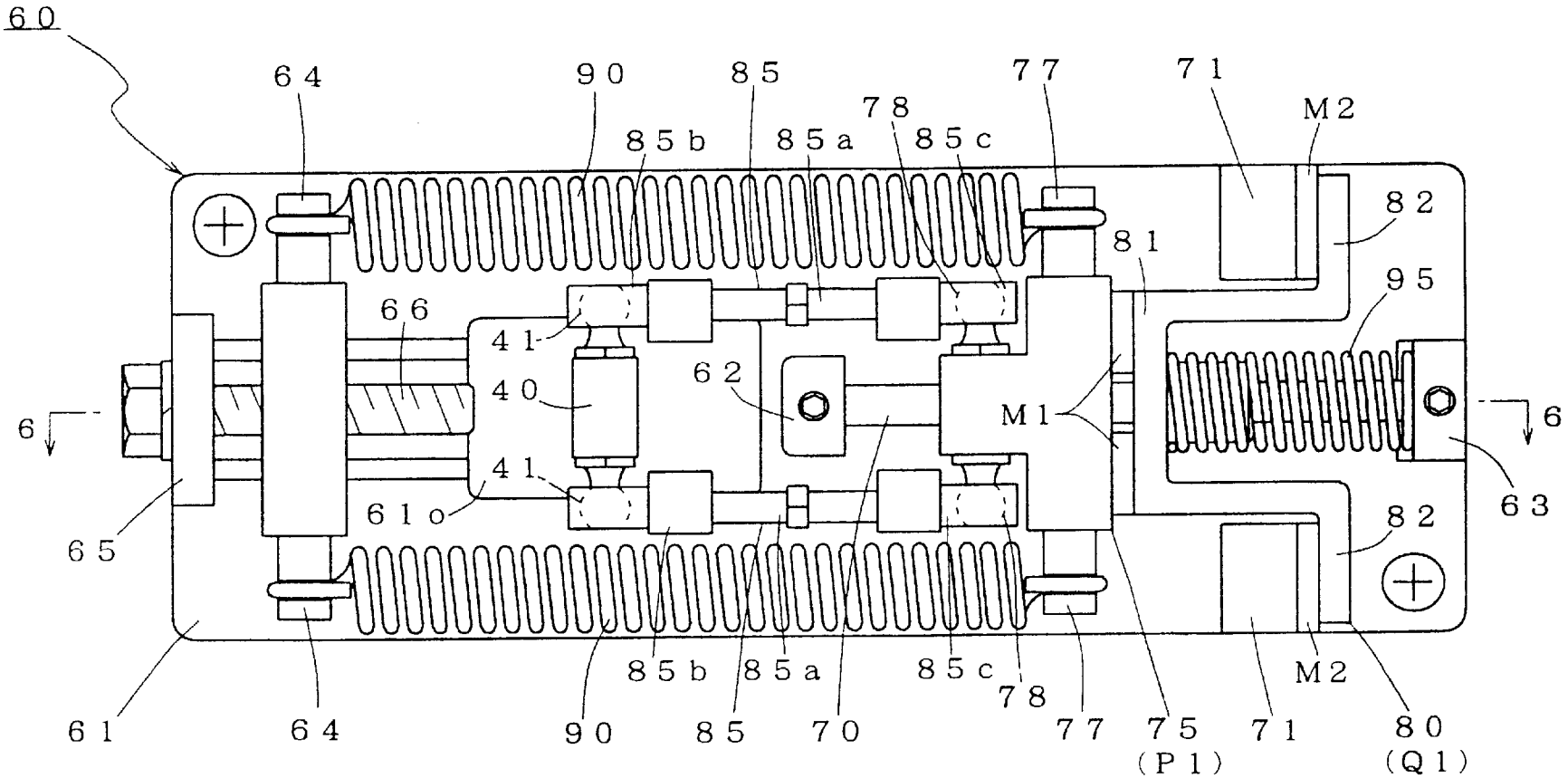
FIG. 4 is a bottom view showing the reverse side mechanism of the tremolo device.
Figure 7:
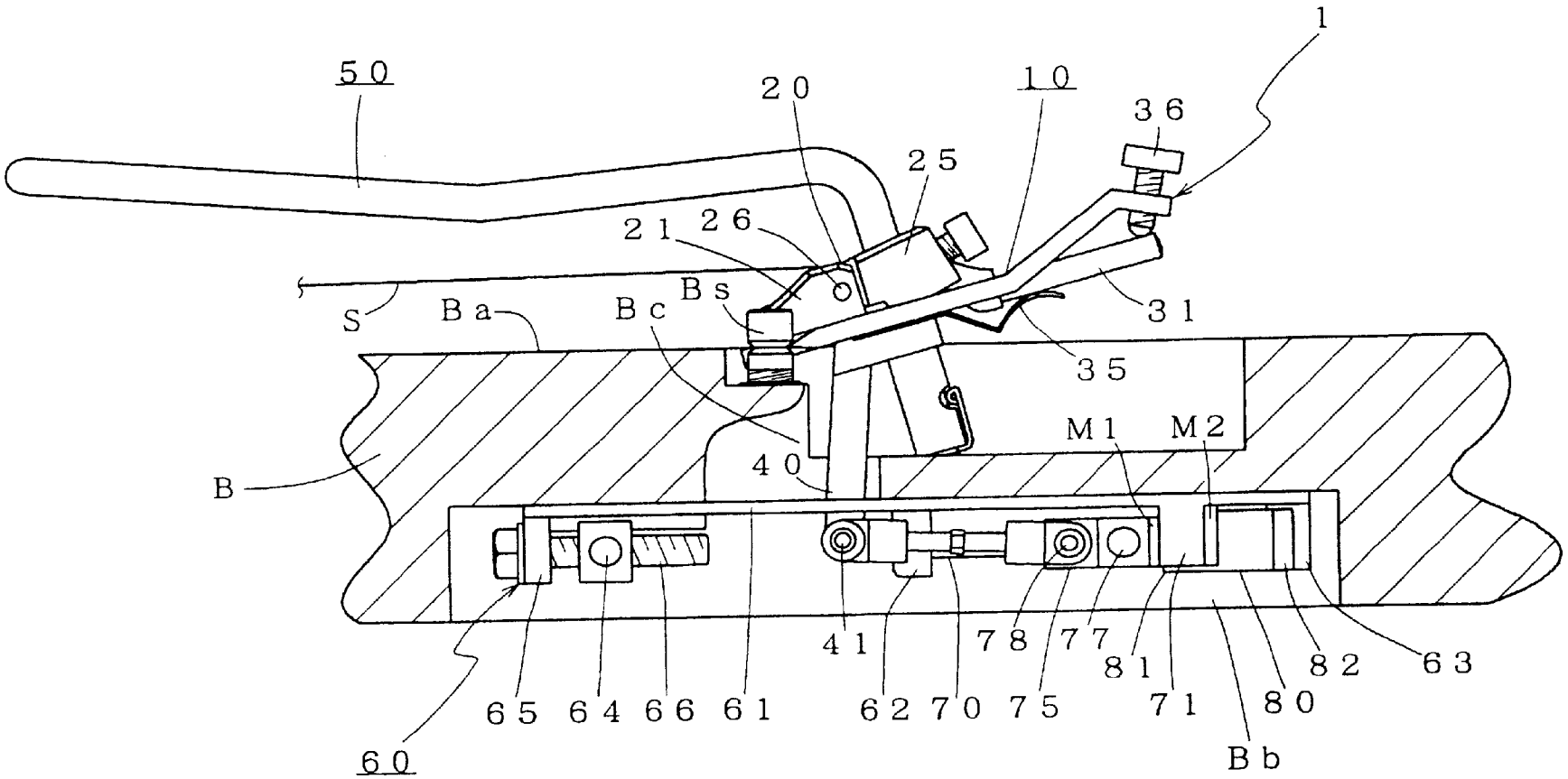
FIG. 7 is a cross section of the tremolo device, with some members removed when the musical intervals are coming down, and its surrounding elements.
Figure 8:
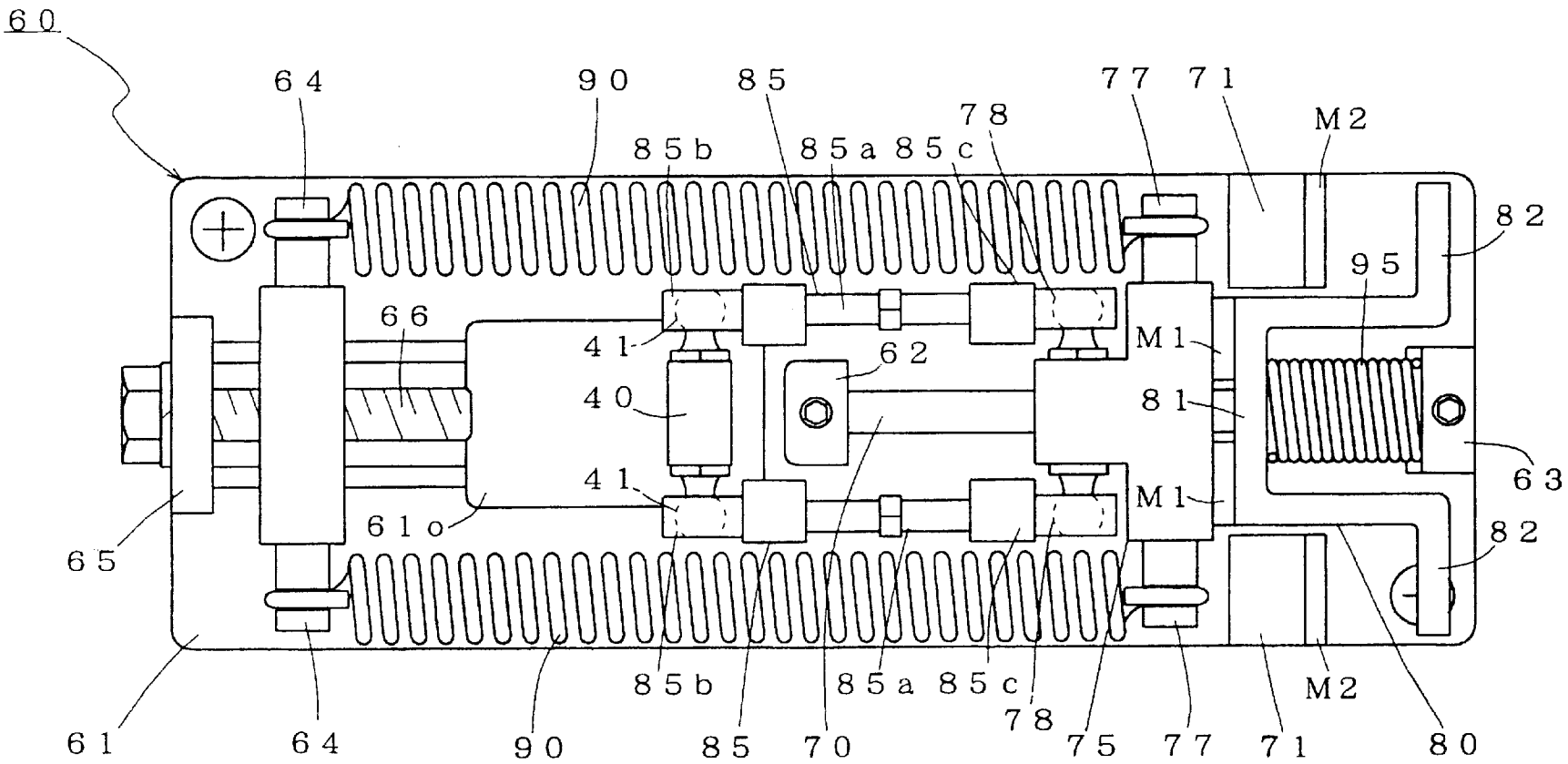
FIG. 8 is a bottom view showing the reverse side mechanism of the tremolo device during lowering intervals.
Figure 9:
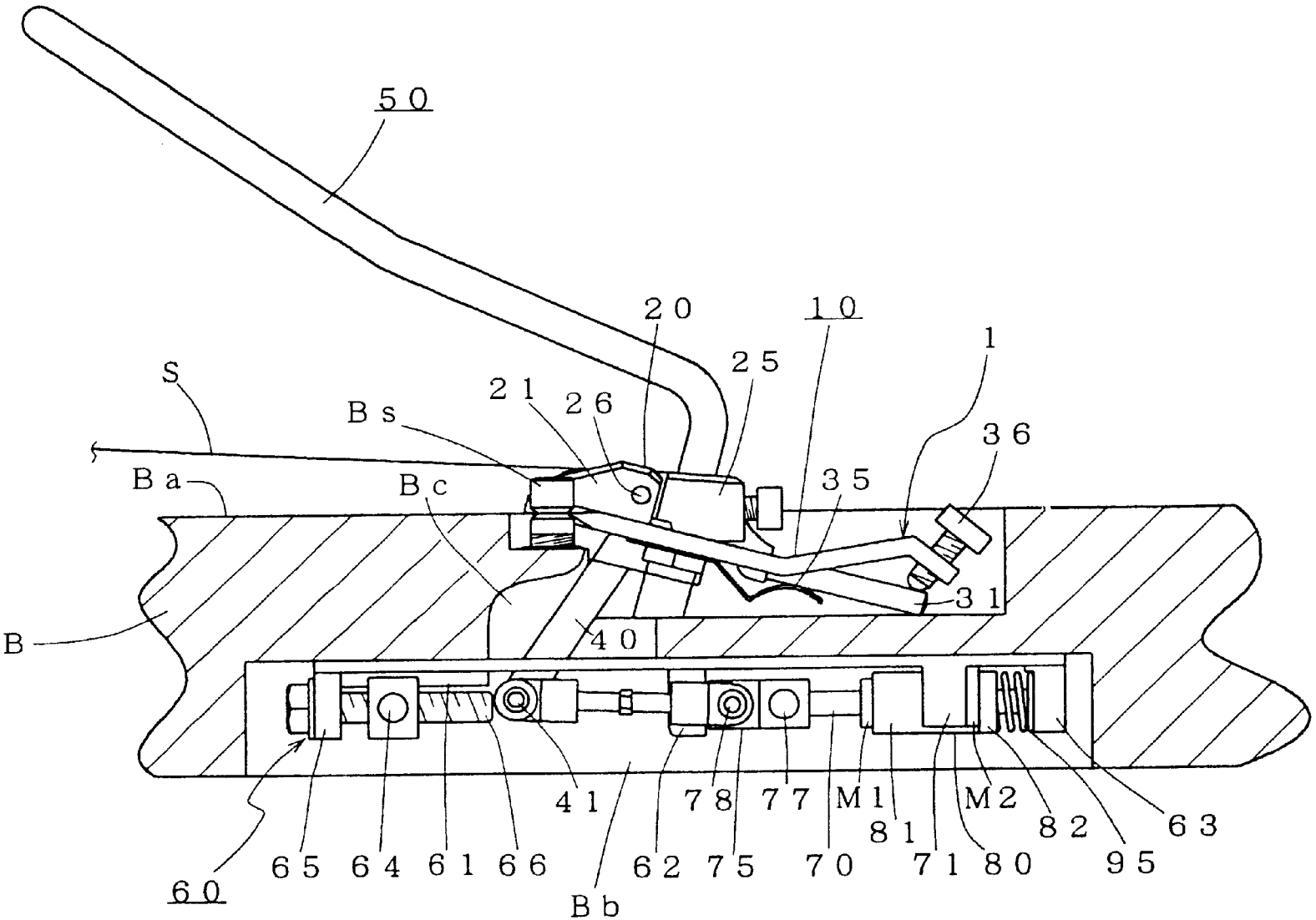
FIG. 9 is a cross section of the tremolo device, with members removed, during rising intervals, and surrounding elements.
Figure 10:
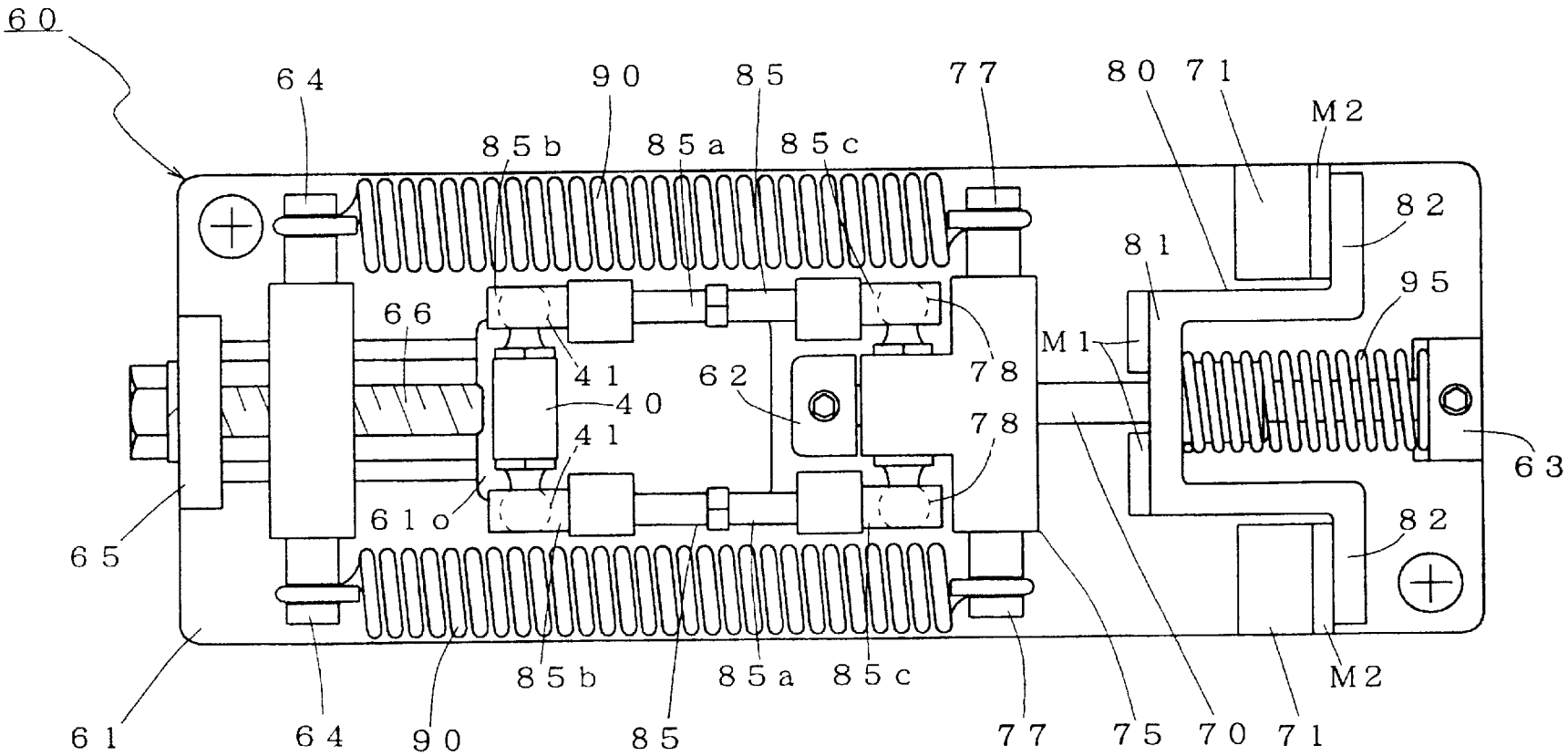
FIG. 10 is a bottom view showing the reverse mechanism of the tremolo device during rising intervals.

In this example, a plurality, here six, of string supports 20 are arranged on the base plate 11, each for a respective strings S, for enabling tone color adjustment for each string S. FIG. 3 is a cross section that shows the tremolo device 1 when the tremolo body is in a state of equilibrium as it is not being used and also shows its surrounding elements. FIG. 4 is a bottom view showing the bottom side mechanism during the equilibrium state. In FIG. 3, the first spring 90, described below, is omitted for convenience of explanation. That same drawing modification is also made in FIGS. 7 and 9.

The base plate 11 in this embodiment is supported to swing around stud bolts Bs and Bs at the knife edges 12 at both lateral sides of the front (on the neck N side) of the base plate.

A plurality of opening grooves 13 are formed in the base plate aligned with the positions of the various string supports 20 approximately at the center of the base plate 11.

Figure 2:
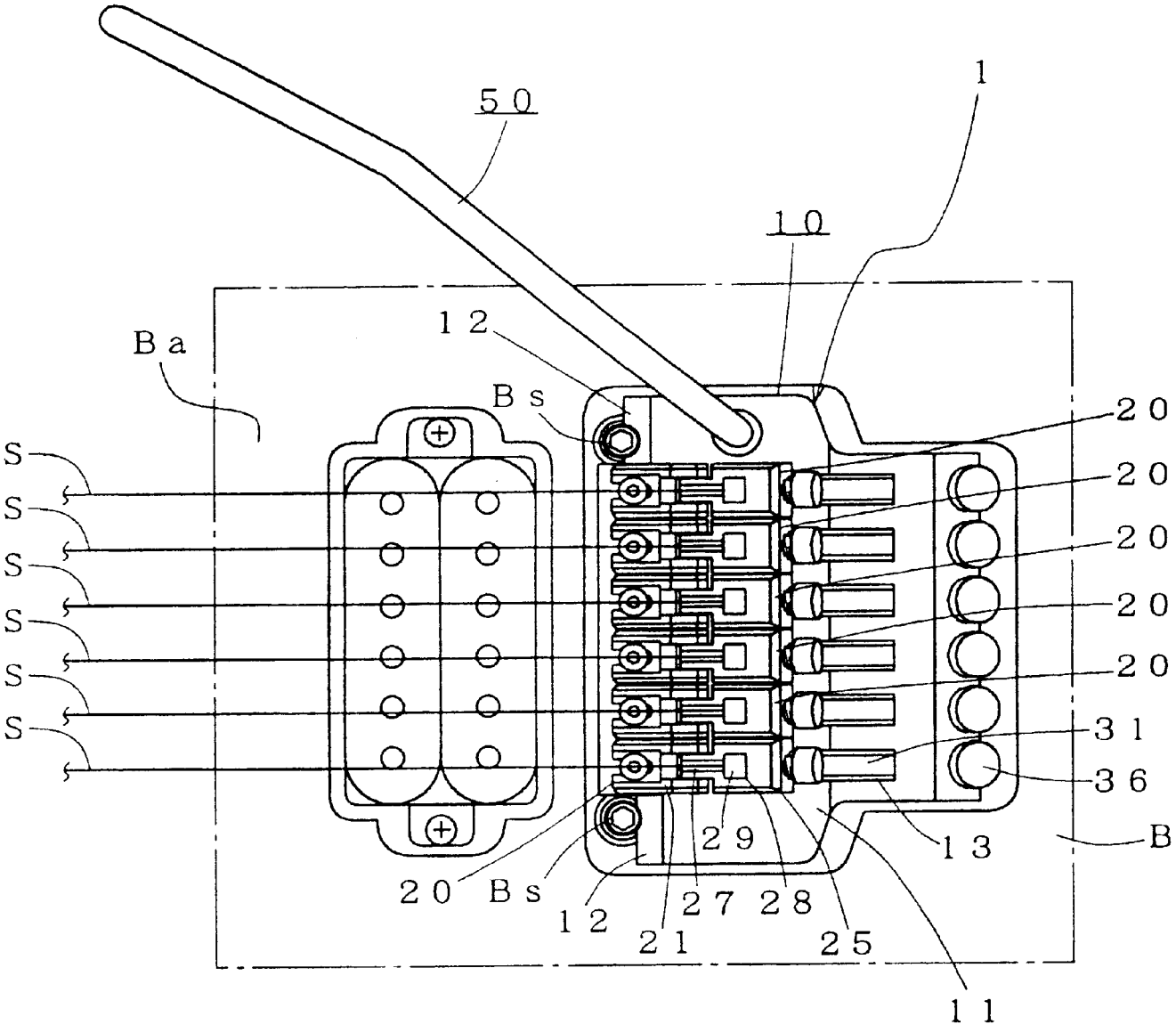
FIG. 2 is a front view of the tremolo device.

Referring to FIGS. 2 and 3, each string support 20 has a saddle holder 21, a main saddle body 25 and a rotation adjusting rod 31. The saddle holder 21 is fixed on the base plate 11 to be adjustable back and forth (left and right in FIG. 3) along the body B. The main saddle body 25 is supported to be rotatably adjusted back and forth on the saddle holder 21 through an axle 26 that extends across the stretching direction of the string at a right angle.

The main saddle body 25 has a string receiver 27 formed like a curved surface on its front part. A concave 28 for fixing the strings is formed at the rear of the body 25. Each string S is fixed by holding the terminal region of the string S against the inner wall of the string fixing concave 28 by the string fixing block 29. In addition, the string fixing block 29 is fixed by the tip of a rotation adjusting rod 31 that is screwed into the concave 28 for fixing the string.

To the rear of each main saddle body 25, there is a rotation adjusting rod 31 for freely manipulating the rotation adjustment of the main saddle body 25 back and forth. The bar 31 protrudes rearward and is inserted into the respective opening groove 13 in the base plate 11.

A plate spring 35 on the underside of the base plate 11 continuously urges each rotation adjustment bar 31 in the direction of forward rotation of the main saddle body 25.

An adjusting, fine tuning bolt 36 adjusts string stretching through rotation of each saddle body 25 by the forward and backward movement (or the vertical movement in the drawing) by contacting each rotation adjusting bar 31 against the urging of its plate spring 35.

If the adjusting screw 36 is rotated clock-wise, the rotation adjustment bar 31 is moved down (in the rotation direction to the rear). As the main saddle body 25 is rotated backward together with the bar 31, the tensile force (the musical interval) rises. Contrarily, if the adjustment screw 36 is rotated counter clock-wise, the rotation adjusting bar 31 rises (in the rotation direction to the front). This rotates the main saddle body 25 to the front, reducing the tensile force of the string (or the interval).

Each string support 20 is of the rocking type including a saddle holder member 21 and a main saddle body 25. However, the invention is not limited to this and each string support may be of the non-rocking type which is more general.

In this example, there are a plurality of independent string supports 20 each for a string S, thereby enabling tone color adjustment for each string S. However, it is possible to provide a string support member of the one-piece type on the base plate.

Referring to FIGS. 3 and 4, tremolo block 40 protrudes below the reverse side of the base plate 11 and is inside the opening Bc that links the front and rear of the body B. At both sides of the tip or free end of the tremolo block 40, there are link installation journals 41, globular shaped in the drawing, that engage respective links 85, described below, in a freely rotatable fashion.

The bottom side mechanism 60 comprises a bottom side base 61, a first bearing block 62 and a second bearing block 63, an axial slide 70, positioning stoppers 71, a slide block 75, a movable stopper 80, links 85, first springs 90 and a second spring 95.

Figure 6:
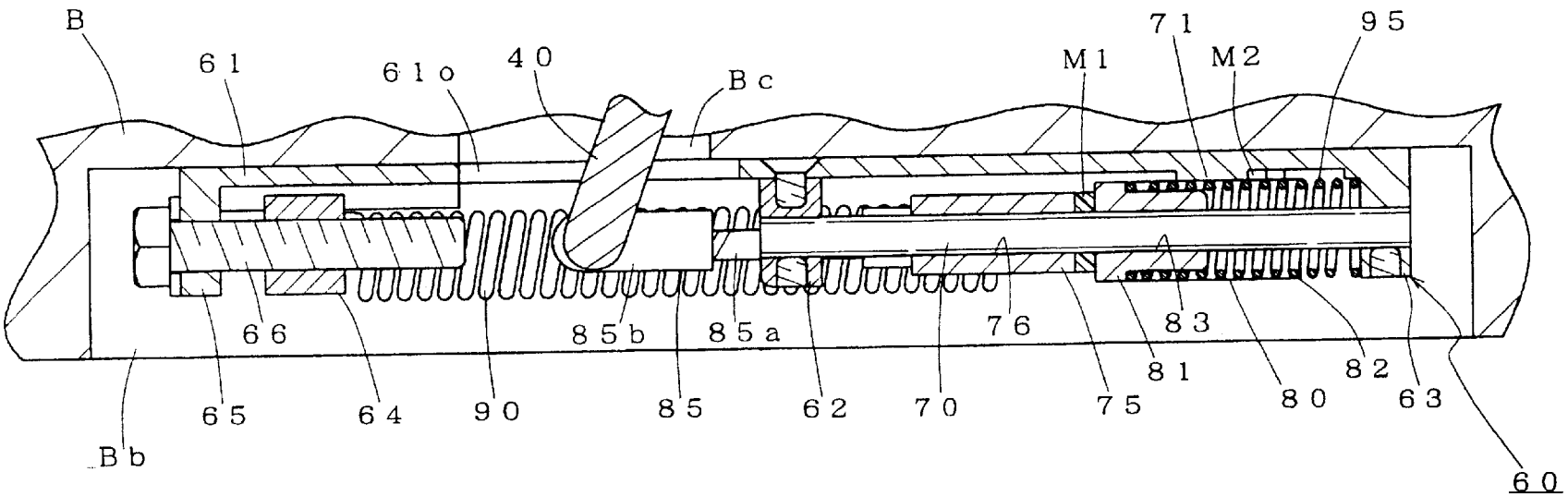
FIG. 6 is a cross section along line 6—6 in FIG. 4.

The bottom side base 61 serves as the installation part for the bottom side mechanism 60 and it is fixed to the bottom side of the body B in the concave Bb 61*o* by a screw, etc. In FIG. 6, an opening 61*o* that corresponds in location to the opening Bc in the body B is formed slightly to the front at the center of the base 61. The tip of the tremolo block 40 is positioned in the opening 61*o*. A first bearing 62 is provided approximately at the center (the periphery on the rear side of the opening 61*o*) of the base 61. A second bearing 63 is provided at the rear. An axial slide 70 is disposed between the first bearing 62 and the second bearing 63.

First spring front side installation blocks 64 support the front end of each first spring 90. The blocks 64 are installed such that their positions may be adjusted relative to the bottom side base 61.

The blocks 64 are screw threaded on the adjustment screw 66 which is screwed into a screw hole of a bracket 65 that protrudes at the front of the bottom side base 61. The blocks 64 are adjustable in position by operating the adjusting screw 66.

The foregoing enables the forces exerted by the first springs 90 to match the tension of the respective strings S at various string gauges that are used, by positional adjustment of the blocks 64. In addition, positioning stoppers 71 regulate the progress or movement of a movable stopper 80 between the first bearing 62 and the second bearing 63 at the side base 61.

A slide block 75 is provided on the front of the axial slide 70, and a movable stopper 80 is mounted on the rear of the axial slide 70 in such a manner and the block 75 and stopper 80 can be freely moved back and forth along the axial slide 70.

Figure 5:
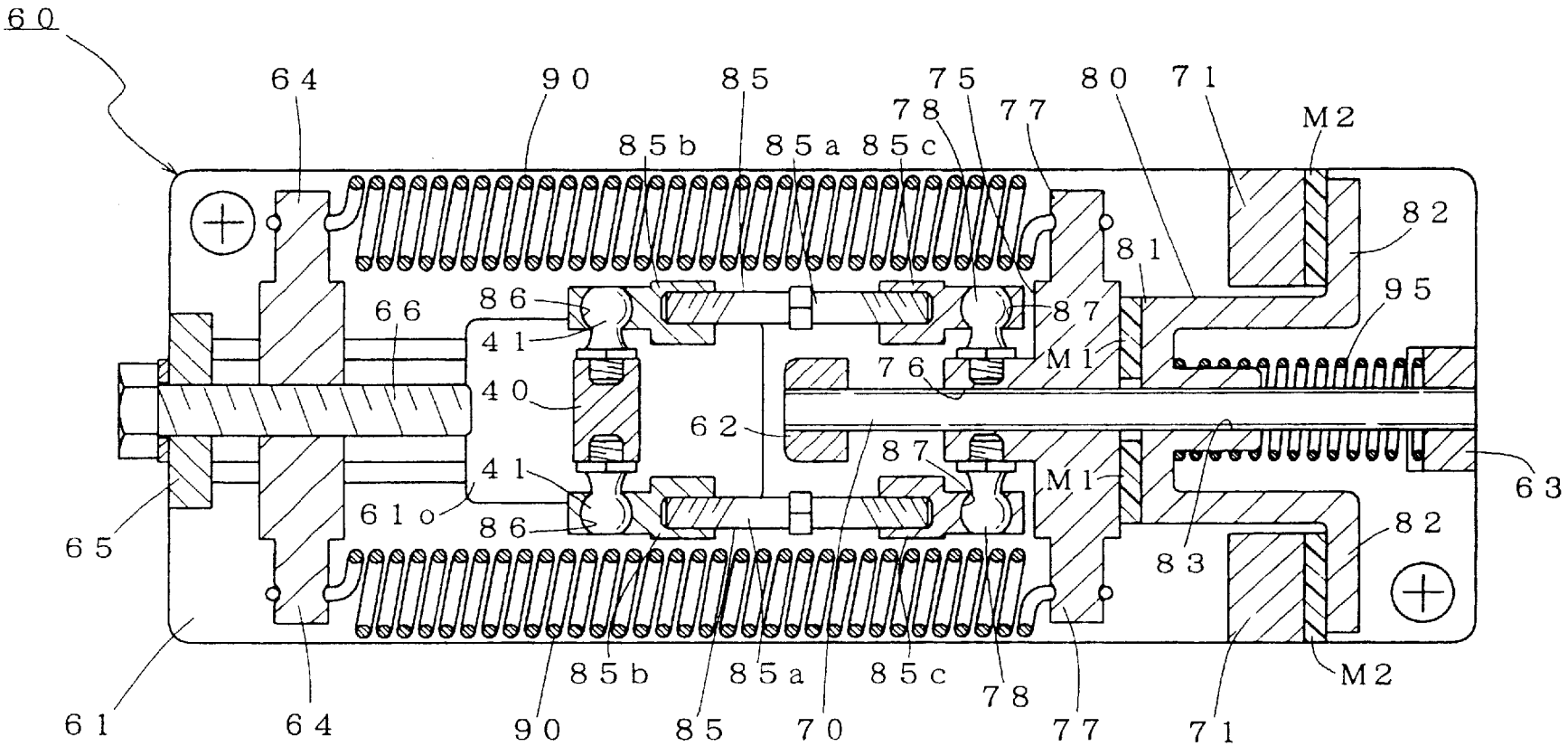
FIG. 5 is a cross section along line 5—5 in FIG. 3.

FIGS. 5, 6 shows an axial hole 76 for the slide block 75 and an axial hole 83 for the movable stopper 80. The slide block 75 includes the first spring rear installation blocks 77 for supporting the rear ends of the first springs 90.

There are also link installation parts 78 (globular in the drawing) that engage with the links 85, as explained below.

The movable stopper 80 has a front part 81 that can either touch or be separated from the rear surface of the slide block 75, through a buffer M1, on the rear surface of the slide block 75. The moveable stopper 80 has two rear parts 82 that can touch the rear surface of the positioning stoppers 71, through the buffers M2. The rear parts 82 that may protrude parallel to the positioning stoppers 71 at both ends of the front part 81 which is approximately U-shaped in FIG. 5. The number of positioning stoppers 71 that correspond to the shape of the movable stopper 80 and the shape of the movable stopper itself 80 are not limited by those mentioned above.

The buffer M1 is comprised of rubber, etc. and is interposed between the slide block 75 and the movable stopper 80. The buffer can absorb the impact of the slide block 75 and the front 81 of the movable stopper 80 contacting each other, thereby reducing the generation of strange noise, such as contact noise, etc. The buffer Ml is fixed to the surface of the front portion 81 of the movable stopper 80, although the buffer M1 can be fixed to the rear surface of the slide block 75.

Buffers M2 are comprised of rubber, etc. and are interposed between the rear parts 82 of the movable stopper 80 and the positioning stoppers 71, enabling the buffers M2 to absorb the impact of contact between the rear parts 82 of the movable stopper 80 and the positioning stoppers 71 and thus reducing generation of strange noise, such as contact noise, etc. The buffers M2 are fixed to the rear surfaces of the positioning stoppers 71, but the buffers M2 may be fixed to the rear surfaces 82 of the movable stopper 80.

In addition, contact between the slide block 75 and the front part 81 of the movable stopper 80 and contact between the rear parts 82 of the movable stopper 80 and the positioning stoppers 71 are surface contacts, over comparatively large areas, making it difficult for such deformation of the buffers M1 and M2 as will have some effect on tuning.

The links 85 link the tip of the tremolo block 40 and the slide block 75, converting the rotary or swinging movement of the tremolo block 40 into straight-line sliding of the slide block 75. The links 85 are engaged, in a freely rotatable fashion, on the link installation parts 41 on both sides of the tip of the tremolo block 40 through the tremolo block side engaging holes 86 in the links 85.

Linkage between the links 85 and the tremolo block 40 and the slide block 75 is through a ball-joint system. This makes it easy to cope with the incline of the tremolo body 10, back and forth and right and left, etc. in connection with the adjustment of the tilting of the tremolo body 10 by the stud bolts Bs.

Preferably, the rotation fulcrums of the links 85 and the tremolo block 40 at the link installation parts 41 of the tremolo block 40 are preferably positioned immediately below the swinging axis of the tremolo body 10 (the line linking two stud bolts Bs for fixing the base plate 11 in a freely swinging fashion). This has an advantage of being able to convert swinging of the tremolo body 10 effectively into the sliding movement of the slide block 75 and the movable stopper 80.

The links 85 are designed to permit both their expansion and contraction. This makes it possible to adjust the initially set angle (the angle at the time when the tremolo is not in use) of the tremolo body 10 (base plate 11) by expansion or contraction of the links 85. An additional advantage is that this can cope with tilting of the stud bolts Bs.

An example of a freely expandable and contractable link 85 uses a turn-buckle construction of each link 85. The link 85 comprises a main link body 85*a* with outer screw threads provided on its outside periphery, a tremolo block side engagement part 85*b* with internal screw threads that fit the outer screw threads of the main link body 85*a* as it has the tremolo block side engagement hole 86, and a slide block side engagement part 85*c* with inner screw threads that fit the outer screw threads of the main link body 85*a* as the part 85*c* has a slide block side engagement hole 87. When the main link body 85*a* is rotated or moved back and forth with respect to the tremolo side engagement part 85*c*, the link 85 is either expanded or contracted in length. The structure for making each link 85 expandable or contractable freely is not limited to the example shown above.

The first springs 90 and the second spring 95 maintain a state of equilibrium (a balanced state) of the tremolo body 10 (base plate 11) by their own spring forces which counters the tensile forces of the strings S installed on the Ba side on the surface of the body. Together, these elements restore the slide block 75 and the movable stopper 80, whether they have been moved by the swinging of the tremolo body 10, to their original positions prior to the shift.

The first springs 90 are interposed between the first spring front-side installation blocks 64 toward the front of the bottom side base 61 and the first spring rear-side installation blocks 77 provided on the slide block 75. The first springs 90 are elongated from their natural length when the tremolo body 10 assumes a state of equilibrium and urges the slide block 75 in the forward direction, the direction of the first spring front-side installation block.

The second spring 95 extends between the front 81 of the movable stopper 80 and the second bearing 63. Moreover, the second spring 95 is externally installed on the axial slide 70. Meanwhile, the second spring 95 between the front 81 of the movable stopper 80 and the second bearing 63 is contracted, as compared with its natural length when the tremolo body 10 assumes a state of equilibrium, and this urges the movable stopper 80 in a forward direction, in the direction of the slide block.

Therefore, the forces of the first springs 90 and the second spring 95 work in the same direction in the tremolo device 1. The second bearing 63 may be installed so that its position is adjustable with respect to the bottom side mechanism base 61, and the force of the first springs 90 may be adjusted by adjusting the position of the second bearing 63.

The slide block 75 is positioned at its first slide block position P1 by the tensile force of the string S and the forces of the first springs 90 and the second spring 95 when the tremolo arm 50 is not in operation. The movable stopper 80 is then positioned at the first movable stopper position Q1, and the slide block 75 and the front part 81 of the movable stopper 80, plus the rear parts 82 of the movable stopper 80 and the positioning stoppers 71 touch each other, causing the tremolo body 10 to assume a state of equilibrium.

If there were no strings S, the slide block 75 would remain positioned to the front of the first slide block position P1 due to the force of the first springs 90 and, at the time of tuning by fixing each string S to the string support member 20, the slide block 75 is caused to gradually move backward (to the movable stopper side 80) due to balancing between the tensile force of the string S and the force of the first springs 90.

In an example of a six-string guitar, the total force of the first springs 90 can be set at [⅚×To−(alpha)] equivalent value where To indicates the total string tensile force after tuning. At the same time, the force of the second spring 95 can be set at [⅙×To+(beta)] equivalent value. The (alpha) and (beta) are values such that no difference stemming from the change in spring chord is produced, no change is produced in the string tensile force at the time when the hand is placed on the arm or at the time of choking and no fluttering takes place. Moreover, (alpha) and (beta) are set such that (beta) is larger than (alpha) which is larger than zero.

The slide block 75 is positioned at the first slide block position P1 so as to touch the front part 81 of the movable stopper 80 when the total string tensile force has reached said [⅚×To−(alpha)] equivalent value during the course of tuning.

The sum of the force of the first springs 90 and the force of the second spring 95 becomes [⅚×To−(alpha)]+[⅙×To+(beta)]=To+(beta)−(alpha). As this is greater than the total string tensile force To subsequent to tuning, the slide block 75 and the movable stopper 80 do not move even if the tensile force of the string is increased from the time when the slide block 75 has touched the front part 81 of the movable stopper 80 to the completion of tuning.

If the tensile forces of the first springs 90 and the force of the second spring 95 are set as described above, mutilation of one of the six strings would produce a remaining tensile force of approximately ⅚×To. In view of the fact that the force of the first spring 90 is [⅚×To−(alpha)] and that the remaining string tensile force is greater than that force, the slide block 75 does not move, as it stays at the first slide block P1 where it touches the front 81 of the movable stopper 80.

Even if one of the six strings has been mutilated, the equilibrium state of the tremolo body 10 can be maintained, thereby keeping the remaining strings in their tuned states. Thus, any change in the musical intervals of the remaining strings can be prevented.

In the tremolo 1, if the arm 50 is brought into an "arm down" state or if it is held in the direction of the body surface Ba, the tremolo body 10 (base plate 11) swings to tilt to the front (neck N direction) with the stud bolts Bs as the fulcrum. The tensile force of each string S is reduced and the musical interval of each string comes down (flat). The tremolo block 40 that protrudes down from the base plate 11 rotates to the rear, counter clock-wise in the drawing. This moves the slide block 75 and slides the movable stopper 80 rearward along the axial slide 70 through the links 85, which separates the rear parts 82 of the movable stopper 80 away from the positioning stoppers 71.

Subsequent to the arm-down position, if the force on the arm 50 is removed or if operation of the arm 50 is stopped, the slide block 75 and the movable stopper 80 slide forward, while touching each other. When the rear parts 82 of the movable stopper 80 have touched the positioning stoppers 71, that movement stops restoring the slide block 75 and the movable stopper 80 to their original positions (the first slide block position and the first stopper position), and restores the tremolo body 10 to a state of equilibrium.

On the other hand, when the arm 50 is pulled in the direction away from the body surface Ba, the tremolo body 10 and the base plate 11 swing to tilt backward in the direction opposite to the neck N, around the stud bolts Bs and Bs as the fulcrum. This increases the tensile force of each string S and the intervals of each string rise (become sharp). This rotates the downwardly protruding tremolo block 40 to the front (clock-wise in the drawing). As a result, only the slide block 75 slides to the front along the axial slide 70 through the links 85. Thus, the slide block 75 separates from the front part 81 of the movable stopper 80.

If the total string tension when the tremolo body 10 is in a state of equilibrium is expressed by To and the force of the first springs 90 (initially set value) is expressed by $U_1$, the force required for the arm-up operation will become [To−$U_1$]. A tremolo device having this construction enables raising the arm (elevation of the musical intervals) with a force which is smaller by the force $U_1$ of the first springs 90, as compared with the tremolo device which is described in Toku Kai Hei 1-93793.

If, subsequent to the arm-up operation, the force applied on the arm 50 is removed or if operation of the arm 50 is stopped, the slide block 75 is slid rearward by the tensile force of each string S and the block 75 stops when the slide block 75 has touched the front part 81 of the movable stopper 80, followed by the restoration to the original position. This restores the tremolo body 10 to a state of equilibrium. The rearward slide or return movement of the slide block 75 after stopping of operation of the arm 50 can be made smooth by setting the force of the first springs 90 smaller than the total string tensile force.

Because the tremolo body 10 always returns to its original equilibrium state after a tremolo operation, in a stringed instrument equipped with the tremolo device 1 (a six-string guitar in this case), this enables eliminating inconvenience such as tuning failure which was experienced in the past. In addition, generation of noise stemming from contacts among the members of the restoration mechanism for restoring the tremolo body, when the tremolo body 10 returns to its original equilibrium state, can be prevented by action of the buffers M1 and M2.

In the tremolo device 1, the tremolo body 10 is maintained in the state of equilibrium at all times by the restoring action of the restoration mechanism 80 comprised of axial slide 70, positioning stoppers 71, a slide block 75, a movable stopper 80, links 85, the first springs 90, and the second spring 95 when the tremolo is not in operation. As a consequence, failures in tuning stemming from choking, fluttering or string mutilation, etc. can be prevented to a maximum degree.

Figure 11A:
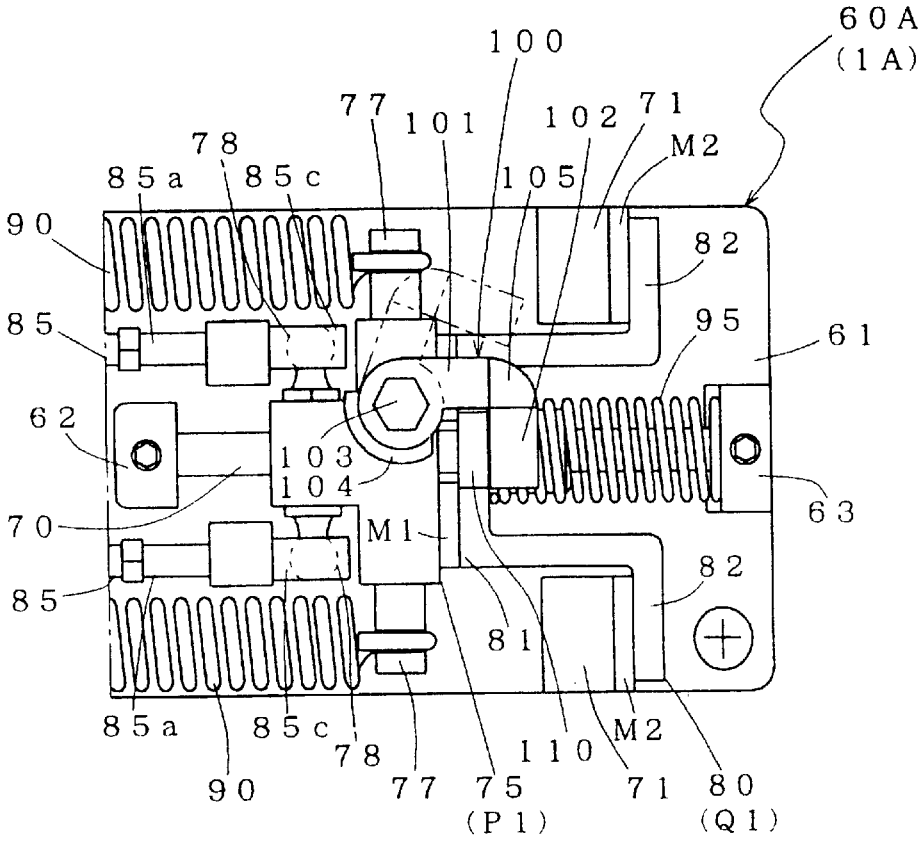
FIG. 11A is a partial bottom view of the tremolo device and FIG. 11B is a partial side view of the same reverse side mechanism.
Figure 11B:
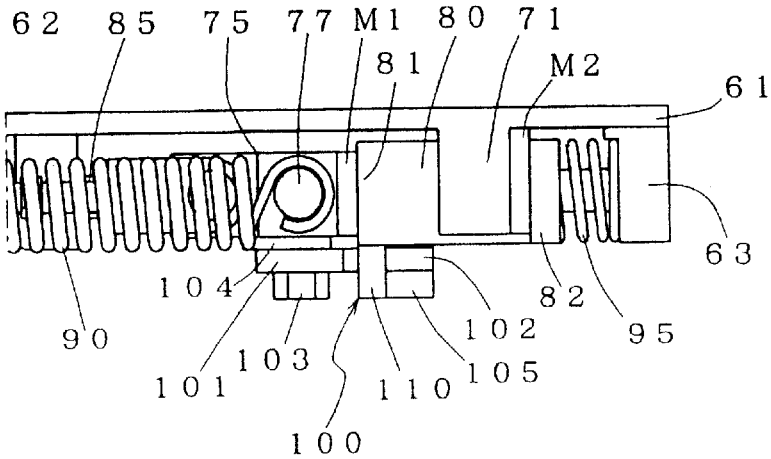

A tremolo device 1A according to another example of the invention is explained, with reference to FIG. 11. As tremolo device 1A has approximately the same construction as the tremolo device 1, the same elements as in the tremolo device 1 have the same numbers and their explanations are omitted. The characteristic feature of the tremolo device 1A is described.

The tremolo device 1A includes an engagement mechanism 100 which is capable of engagement or disengagement and is provided between the slide block 75 of the bottom side mechanism 60A and the movable stopper 80. The slide block 75 and the movable stopper 80 are engaged by the engagement mechanism 100, for regulating the forward movement of the slide block 75. In this example, the engagement mechanism 100 is comprised of a rotatable member 101 which is approximately L-shaped including a bent piece 102 on the tip side (free terminal side). It is installed freely rotatably on the slide block 75 and is also located at a protrusion 110 which protrudes to the back side (side which is opposite to the bottom side base 61) which protrusion is at the front of the movable stopper 80.

As the bending piece 102 on the tip side of the rotary member 101 is positioned behind the protrusion 110 and both are engaged as shown in solid lines in FIG. 11, forward movement of the slide block 75 is regulated.

On the other hand, the slide block 75 is enabled to move to the front as the rotary member 101 is rotated to the front (counter clock-wise in the drawing) and as the engagement between the rotary member 101 and the protrusion 110 is released, as shown by the broken or chain line of FIG. 11A.

An axle 103 installs the rotary member 101 freely rotatably on the slide block 75. A rotary upward member 104 of rubber, etc. is disposed for making the rotation of the rotary member 101 smooth. A concave 105 is provided on the tip of the rotary member 101 for facilitating its rotation.

The rotary member 101 is installed on the slide block 75 while the protruding part 110 is provided on the movable stopper 80. However, it is possible to reverse that and provide the rotary member on the movable stopper and the protruding part on the slide block. Moreover, the engagement mechanism is not restricted to the construction shown.

An engagement mechanism 100 that regulates the forward movement of the slide block 75 makes it possible to regulate the forward movement of the slide block 75 by the engagement mechanism 100 and to effect the arrangement and tuning of each string in the state where the slide block 75 has been put to the first slide block position or in the state where the tremolo body 10 has been brought into a state of equilibrium from the standpoint of initial setting. When a string is to be tuned, therefore, it becomes possible to prevent the intervals of other strings which have been tuned from moving up or down thereby facilitating the placement of the string or its tuning. Further, the force required at the time of placing the string or its tuning can be reduced and, removal of the string becomes simpler.

Figure 12:
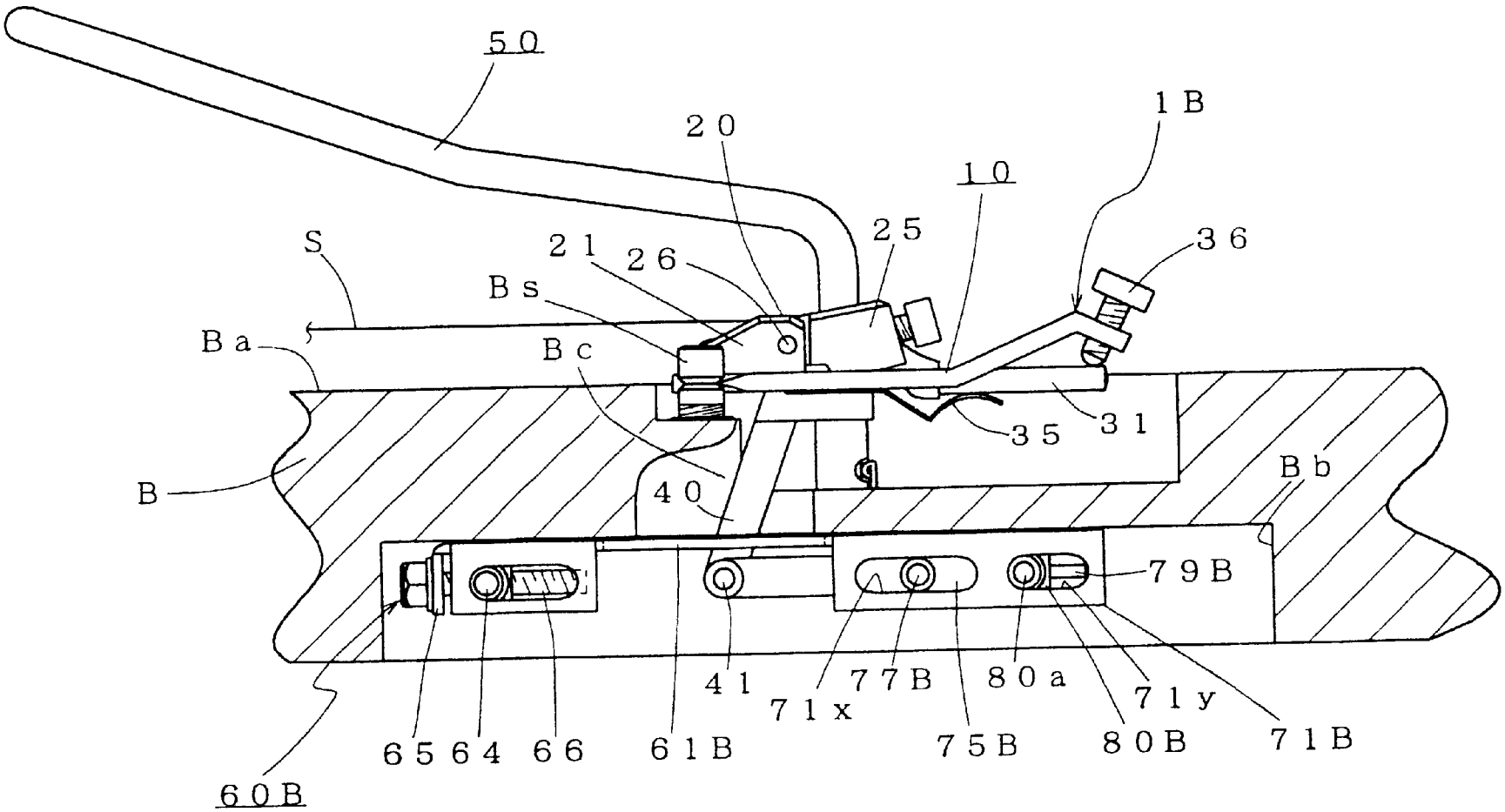
FIG. 12 is a cross section of a third embodiment of a tremolo device with some of the members removed and showing surrounding elements.
Figure 13:
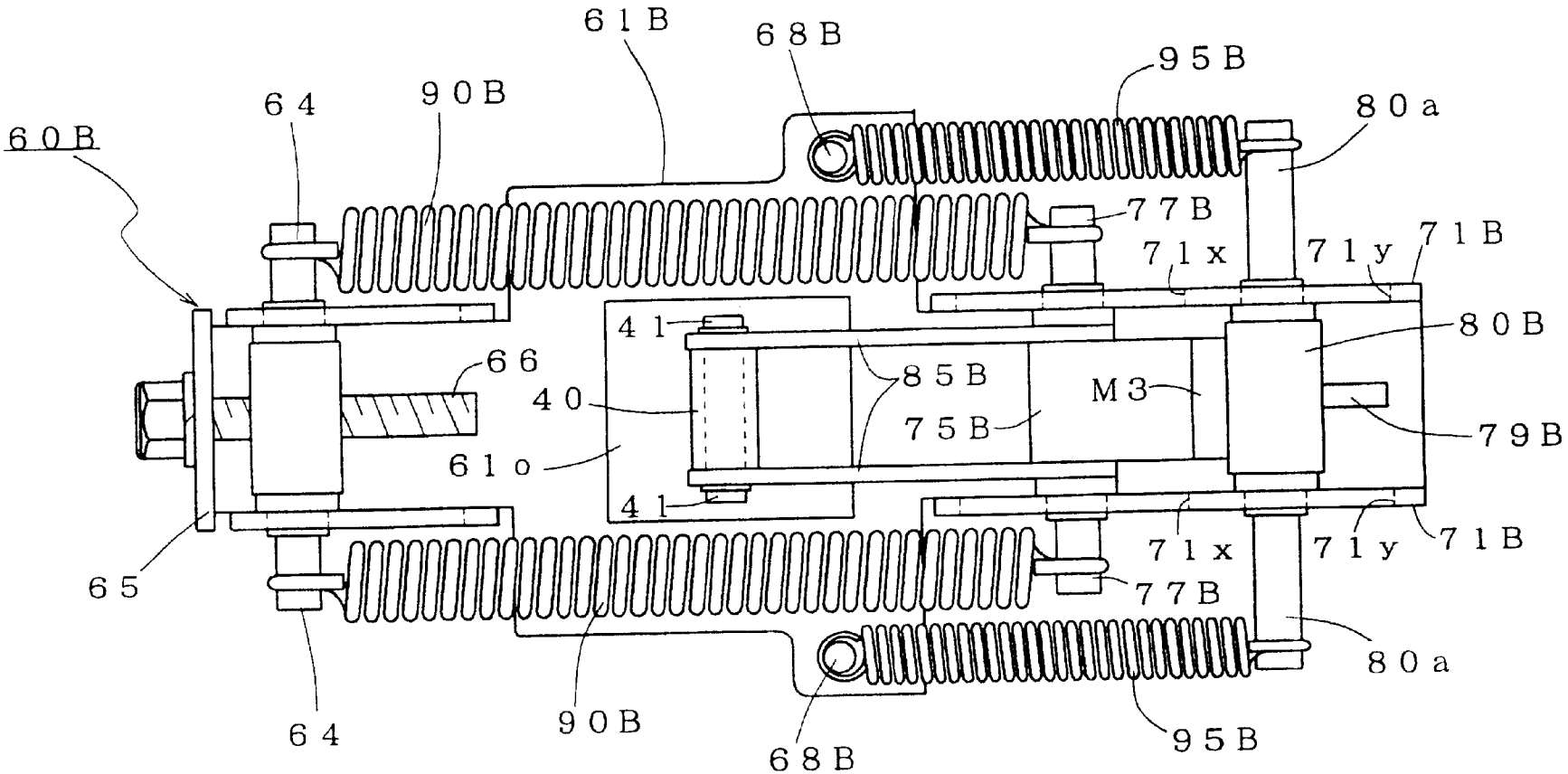
FIG. 13 is a rear side view showing the reverse side mechanism of the third embodiment of a tremolo device.
Figure 14:
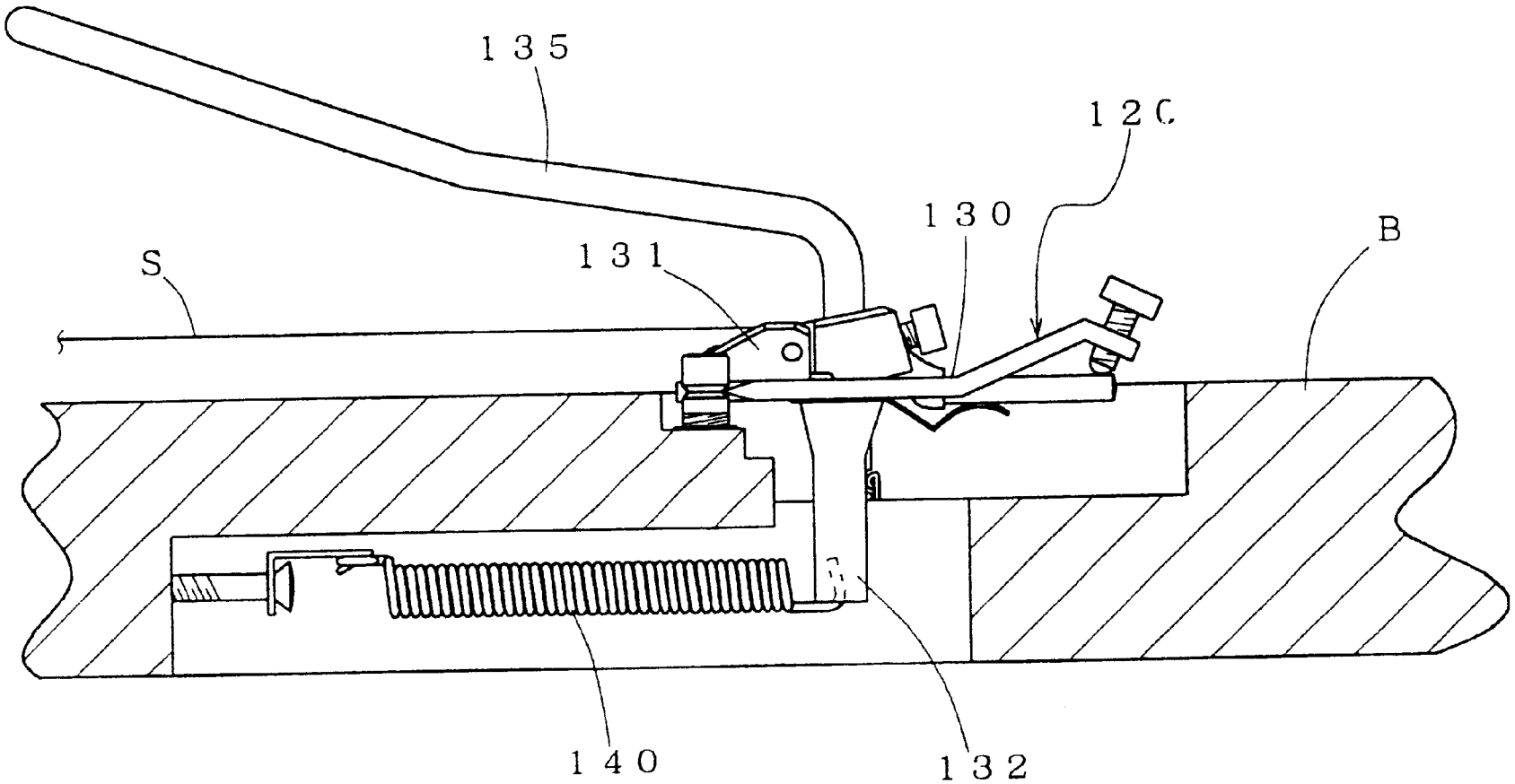
FIG. 14 is a side cross section of a prior art embodiment of a tremolo device.

Another tremolo device embodiment 1B of the invention is explained with reference to FIGS. 12 and 13. The tremolo device 1B has approximately the same construction as the tremolo devices 1 and 1A in the previous examples. Those elements which are the same as in the tremolo devices 1 and 1A are identified by the same reference numbers. For convenience, the first spring and the second spring, which are described later, are omitted from FIG. 12. Characteristic features of the tremolo device 1B are described.

The bottom side mechanism 60B of this tremolo device 1B comprises a bottom side mechanism base 61B arranged on the bottom side of the body B, the positioning stoppers 71B at the rear of the base 61B, a slide block 75B that moves freely back and forth, a movable stopper 80B which is positioned on the rear side of said slide block 75B and moves freely back and forth, and which is capable of touching or getting away from the slide block 75B and the positioning stoppers 71B, and the links 85B that link the tremolo block 40 and the slide block 75B. The first springs 90B that urge the slide block 75B to the front are arranged between the first spring front-side installation blocks 64 that are on the front part of the bottom side mechanism base 61B and the first spring rear side installation blocks 77B on the front part of the reverse side mechanism base 61B. The second springs 95B which urge the movable stopper 80B to the front are provided between the second spring front side installation blocks 68B that are erected approximately at the center of the bottom side base 61B and the second spring rear side installation blocks 80*a* on the movable stopper 80B.

In this example, the positioning stoppers 71B are erected on the rear part of the bottom side base 61B such that they are in parallel and face each other. Moreover, the front-side windows 71*x* permit insertion of the first spring rear-side installation blocks 77B of the slide block 75B. The windows are formed on the front part of the positioning stoppers 71B. The rear-side windows 71*y* that permit the insertion of the second spring rear-side installation blocks 80*a* of the movable stopper 80B are formed on the rear part.

As the first spring rear-side installation blocks 77B on the slide block 75B or the second spring rear-side installation blocks 80*a* on the movable stopper 80B touch the periphery of the front end and the periphery of the rear end of the front-side windows 71*x* or the rear-side windows 71*y*, movement of the slide block 75B or of the movable stopper 80B either to the front or to the rear is regulated.

The first spring rear-side installation blocks 77B of the slide block 75B play the role of the link installation part that engages with the links 85B. Moreover, an axial part 79B for the movable stoppers protrudes from the rear of the slide block 75B. The movable stopper 80B can freely move back and forth along the axial part 79B for the movable stopper.

A buffer M3 made of rubber, etc. is interposed between the rear face of the slide block 75B and the front face of the movable stopper 80B for reducing the generation of strange sounds like contact noise, etc. by absorbing the impact produced at contact. The buffer M3 is fixed to the rear surface of the slide block 75B. However, it is possible to fix the buffer M3 on the front of the movable stopper 80B.

Like the tremolo devices 1 and 1A, the tremolo device 1B is constructed such that the slide block 75B, the movable stoppers 80B, but specifically the second spring rear-side installation blocks 80*a*, and the positioning stoppers 71B but specifically the front end peripheries of the rear side windows 71*y*, touch each other because of the tensile force of the string S that has been stretched on the body surface Ba side and the forces exerted by the first springs 90B and the second springs 95B, thereby causing the tremolo body 10 to stay in a state of equilibrium.

When the tremolo body 10 is swung to tilt it to the front through operation of the arm 50, moreover, the tremolo block 40 rotates rearward. This slides the slide block 75B and the movable stopper 80B rearward, via the links 85B and the movable stopper 80B, butparticularlythe second spring rear-side installation blocks 80*a*. The slide block moves away from the positioning stoppers 71B, particularly the front end peripheries of the rear-side windows 71*y*. When operation of the arm 50 has stopped, the slide block 75B and the movable stopper 80B are returned to their original positions where the movable stopper 80B touches the positioning stoppers 71B under the forces of the first springs 90B and the second springs 95B, thereby restoring the tremolo body 10 to the equilibrium state.

When the tremolo body 10 is swung to tilt it rearward by operation of the arm 50, further, the tremolo block 40 rotates to the front. This slides the slide block 75B to the front through the links 85B and the slide block 75B moves away from the movable stopper 80B. When operation of the arm 50 stops, the slide block 75B is restored to its original position where it is urged to touch the movable stopper 80B by the tensile force of the string S, thereby restoring the tremolo body 10 into the state of equilibrium.

As explained above, the tremolo 1B functions approximately in the same manner as the tremolos 1 and 1A producing a similar effect to the tremolo devices 1 and 1A.

This invention is not limited by the examples described above, but can be changed in construction within the invention. In each of the examples, for instance, two first springs and two links are provided. Their number, however, is not limited and one of each or three of each can be suitably used. In each example, one or two second springs are used. However, three or more second springs may also be used.

In each of the examples, the positioning stopper that regulates the back and forth movement of the movable stopper is provided on the bottom side mechanism base. However, it is not limited to this, and the positioning stopper may be directly provided on the bottom side of the body.

Each of the examples shows a tremolo that is to be installed on a six-string guitar. However, the invention can be used for other stringed instruments, such as a bass guitar, etc.

The tremolo for stringed instruments of this invention includes a tremolo body that is restored to its original state of equilibrium subsequent to operation of the tremolo by a restoration mechanism which is comprised of the positioning stopper, slide block, movable stopper, links, first springs, second spring, etc. As a result, any failure in tuning after operation of the tremolo can be limited to a minimum. As the tremolo body is maintained in an equilibrium state at all times, further, it becomes possible to prevent possible failures in tuning stemming from choking, fluttering or string mutilation, etc. at the normal time when the tremolo is not being operated. In this tremolo device, moreover, the number of locations requiring adjustment is comparatively small, so that both the locations requiring adjustment and the method for such adjustment are easily understandable to the user, and the tuning becomes easier.

In addition, in the restoration mechanism of the tremolo, the rotary movement of the tremolo block at the time when the tremolo body is swinging is converted into straight-line movement through the link, thereby sliding the slide block and the movable stopper. This makes it possible to prevent possible tilting of the first spring or the second spring or possible deformation in a direction other than the direction of expansion and contraction, which eliminates such inconvenience as the effect upon the restoration force of these springs. Accordingly, it is possible to expect a stable restoration action of the tremolo body.

If the axial slide is installed between the first bearing and the second bearing on the bottom mechanism base, and if the slide block and the movable stopper are constructed in a manner to be freely movable back and forth, in particular, the back and forth movement of the slide block and the movable stopper becomes smooth, smoothing the swinging and restoration of the tremolo body.

If the positioning stopper is provided between the first bearing and the second bearing of the bottom mechanism base, further, the bottom side mechanism can be made compact which is advantageous in terms of design work.

If, on the other hand, the movable stopper is constructed such that a front part is capable of touching and moving away from the slide block and a rear part is capable of touching and moving away from the positioning stopper, this makes it possible to cause the movable stopper to touch and move away from the slide block and the positioning stopper using a simple and compact structure.

If the second spring is provided between the front portion of the movable stopper and the second bearing, or if the first spring is provided between the first spring front-side installation block that is provided on the front portion of the bottom side mechanism base and the first spring rear-side installation block that has been provided on the slide block, this has an advantage that the installation structure of each spring can be made simple and compact.

Moreover, if the rotation fulcrum for the tremolo block and the link is positioned approximately right under the swing axis of the tremolo body, it is possible to easily convert the rotation of the tremolo block effectively into sliding movement of the slide block and the movable stopper, thereby making it possible to stabilize the recovery action of the tremolo body to a greater degree.

If the first spring front-side installation block for the installation of the front end side of the first spring is installed so that its position may be adjusted, with respect to the bottom side mechanism base, this makes it possible to cause the force of the first spring to agree with the tensile force of the string on string gauges that are to be used, thereby making it possible to accommodate various tastes of performers.

If a buffer is interposed between the slide block and the movable stopper or between the movable stopper and the positioning stopper, this makes it possible to absorb the impact at the time of a contact among the members by the buffer when the tremolo body is restored to the state of equilibrium, thereby reducing generation of the contact noise.

In the tremolo, moreover, the contact between the slide block and the movable stopper and the contact between the movable stopper and the positioning stopper becomes a surface contact and the contact area becomes comparatively large. As a result, their surface pressure becomes lower making it difficult to cause such deformation of the buffer that may produce some effect upon tuning.

If the link between the tremolo block and the slide block is capable of expansion and contraction, this enables adjusting the initial setting angle of the tremolo body while the tremolo is not in operation, thereby accommodating various tastes of performers.

If the forces of the first spring and the second spring are directed opposite the direction of the tensile force of the string, if the force of the first spring is made smaller than the total string tension and if, the sum of the forces of the first spring and the second spring is made larger than the total string tension, the slide block and the movable stopper do not move and the tremolo body maintains the state of equilibrium even when the tensile force of the string may be increased from the time when the slide block touches the front portion of the movable stopper to the time when tuning is completed, thereby making it possible to tune in a concise and accurate manner.

Because the force of the first spring is smaller than the total string tension, moreover, the return of the slide block after tremolo operation and, accordingly, the restoration of the tremolo body to the state of equilibrium can be carried out smoothly.

If the engagement mechanism that regulates the forward movement of the slide block is interposed between the slide block and the movable stopper, it becomes possible to regulate the forward movement of the slide block by the engagement mechanism and to carry out the tuning of each string in the state where the state of equilibrium in design is being maintained, thereby making it possible to effect tuning in a more simple and accurate manner.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A tremolo for a stringed musical instrument, wherein the stringed instrument includes a top side with a holder for holding the strings above the top side of the instrument, the instrument includes a bottom, a front which is forward toward the string holder and a rear;

the tremolo including a tremolo body supported at the top side of the instrument and toward the rear of the instrument and the strings being supported between the tremolo body and the holder on the instrument which is away from the tremolo body;

a support on the instrument for supporting the tremolo body to swing in first and second opposite directions with respect to the top side of the instrument for adjusting the string tension as the tremolo body is swung, with swinging of the tremolo body in the first direction increasing the tension on the strings and swinging of the tremolo body in the opposite second direction decreasing the tension on the strings;

a tremolo block connected with the tremolo body and extending toward the bottom of the instrument;

a bottom side mechanism toward the bottom of the instrument and being opposite the tremolo body at the instrument, the bottom side mechanism having a rear part toward the rear of the instrument and a front part toward the front of the instrument and toward the string holder, the bottom side mechanism comprising:

a positioning stopper attached to the instrument;

a movable stopper positioned rearward of the positioning stopper, the movable stopper being movable toward the front of the instrument and being shaped for contacting the positioning stopper upon movement of the movable stopped forward for a distance and being movable rearward;

a slide block positioned forward of the movable stopper, and the slide block is movable forwardly and rearwardly with respect to the instrument, with the slide block being movable rearwardly sufficiently and the movable stopper being movable forwardly sufficiently that the slide block may contact the movable stopper during rearward movement of the slide block when the movable stopper is forward, and the slide block and movable stopper being movable to be out-of contact;

a link between the tremolo block and the slide block such that swinging of the tremolo body causes swinging of the tremolo block, and a connection between the tremolo block and the link so that the swinging movement of the tremolo block causes forward and rearward movement of the link;

a first spring provided between the bottom side mechanism on the body of the instrument and the slide block, the first spring normally urging the slide block forward;

a second spring between the movable stopper and the bottom side mechanism and also normally urging the movable stopper forward toward contacting the positioning stopper;

whereby when the tremolo body is not being swung for changing the string tension, the slide block and the movable stopper contact each other and the movable stopper and the positioning stopper contact each other under the tensile force exerted by the strings connected with the tremolo body and against the bias of the first and second springs for bringing the tremolo body into a state of equilibrium;

when the tremolo body is swung to tilt toward the front of the instrument for reducing the tension of the strings, the tremolo block connected with the tremolo body swings to the rear which moves the slide block and the movable stopper toward the rear and separates the movable stopper from the positioning stopper and such that upon discontinuance of swinging of the tremolo body and for reducing the tension of the strings, the slide block is returned forwardly to its original position by urging of the first spring and the movable stopper is urged forwardly by the second spring until the movable stopper contacts the positioning stopper and the tremolo body is thereby in a state of equilibrium;

when the tremolo body is swung to tilt toward the rear of the instrument for increasing the tension on the strings, the tremolo block connected to the tremolo body swings to the front and the link moves the slide block forwardly and moves the slide block away from the movable stopper which is at the positioning stopper; and when swinging of the tremolo body caused by an operator is removed, the tension of the strings moves the slide block to the rear to its original position touching the movable stopper and restores the tremolo body to its state of equilibrium.

2. The tremolo of claim 1, further comprising an operating arm connected with the tremolo body, the arm being operable by an operator for swinging the tremolo body with respect to the instrument.

3. The tremolo of claim 1, further comprising an axial slide supported on the body and extending forwardly and rearwardly, the slide block and the movable stopper being supported on the axial slide for moving forwardly and rearwardly on the axial side; and a first and second separated bearings at the axial slide, and the slide block and the movable stopper are disposed between the first and second bearings.

4. The tremolo of claim 1, when the movable stopper has a front part that projects forwardly and engages the slide block and has a rear part that selectively touches or moves away from the positioning stopper.

5. The tremolo of claim 4, further comprising an axial slide supported on the body extending forwardly and rearwardly and the slide block and the movable stopper are supported on the axial slide for respectively moving forwardly and rearwardly thereon; and a first and second separated bearings at the axial slide, and the slide block and the movable stopper are disposed between the first and second bearings, the second spring being provided between the front side of the movable stopper and the second bearing.

6. The tremolo of claim 1, further comprising a first spring front side installation block toward the front of the instrument and the first spring having a front end attached thereto, and a rear side installation block provided on the slide block and the first spring having a rear end attached thereto.

7. The tremolo of claim 6, wherein the first spring front side installation block is adjustably positionable forwardly and rearwardly with respect to the instrument.

8. The tremolo of claim 1, wherein the tremolo body swings around the support thereof comprising a swinging axis on the instrument, the tremolo further comprising a rotation fulcrum for the tremolo block at the bottom side mechanism where the link is connected to the tremolo block, and the rotation fulcrum is positioned approximately below the swinging axis of the tremolo body.

9. The tremolo of claim 1, further comprising a first buffer between the slide block and the movable stopper.

10. The tremolo of claim 9, further comprising a second buffer between the movable stopper and the positioning stopper.

11. The tremolo of claim 1, further comprising a buffer between the movable stopper and the positioning stopper.

12. The tremolo of claim 1, where the link is adjustable to expand or contract between the tremolo block and the slide block.

13. The tremolo device of claim 1, wherein the first spring and the second spring both have an action direction in the forward direction which is opposite to the direction of tensile force of the strings on the instrument;

the spring force of the first spring is smaller than the total tensile force of the strings; and the sum of the spring forces of the first spring and the second spring in the action direction is greater than the total tensile force of the strings.

14. The tremolo device of claim 1, further comprising an engagement mechanism between the slide block and the movable stopper for selectively engaging the slide block and the movable stopper with each other for regulating the forward movement of the slide block.

* * * * *